US007829804B2

(12) United States Patent
Chou

(10) Patent No.: US 7,829,804 B2
(45) Date of Patent: Nov. 9, 2010

(54) ROLLING-BALL SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 549 days.

(21) Appl. No.: 11/860,841

(22) Filed: Sep. 25, 2007

(65) Prior Publication Data

US 2009/0078546 A1 Mar. 26, 2009

(51) Int. Cl.
*H01H 35/14* (2006.01)

(52) U.S. Cl. ..... 200/61.45 R; 200/61.52

(58) Field of Classification Search ..... 200/52 A, 200/61.45 R, 61.46–61.48, 61.5, 61.52; 340/565, 340/566

See application file for complete search history.

(56) References Cited

U.S. PATENT DOCUMENTS 5,209,343 A 5/1993 Romano et al.
5,332,876 A 7/1994 Romano et al.
6,706,979 B1 * 3/2004 Chou ..... 200/61.45 R
7,230,193 B2 * 6/2007 Chou ..... 200/61.45 R

* cited by examiner

*Primary Examiner*—Renee Luebke
*Assistant Examiner*—Marina Fishman
(74) *Attorney, Agent, or Firm*—Brooks Kushman P.C.

(57) ABSTRACT

A rolling-ball switch is adapted to be fixed on a circuit board, and includes a conductive housing defining a receiving space and having two opposite open ends, two conductive balls disposed movably in the receiving space, two insulation caps covering respectively the open ends to confine the conductive balls in the receiving space, and two terminals connected fixedly and respectively to the insulation caps. The receiving space has first and second widths along first and second directions that are perpendicular to each other. The first width is larger than the sum of diameters of the conductive balls, the second width is larger than the diameter of each conductive ball, and the diameter of each conductive ball is larger than a distance between an inner section of the respective terminal that extends into the receiving space and an inner wall of the conductive housing.

5 Claims, 22 Drawing Sheets

ROLLING-BALL SWITCH

BACKGROUND OF THE INVENTION

1. Field of the Invention

The invention relates to a switch, more particularly to a rolling-ball switch that is mounted on a circuit board for changing between OFF and ON states.

2. Description of the Related Art

Referring to FIG. 1, a conventional electrical tilt switch 10, as disclosed in U.S. Pat. No. 5,332,876, includes a conductive housing 11 having an open end 111 and a closed end 112, a conductive large ball 12 and a conductive small ball 13 disposed within the housing 11, a cap 14 covering the open end 111 of the housing 11, an electrical connector 15 inserted through the cap 14 and extending into the housing 11, and a terminal 16 fixed to the closed end 112 of the housing 11.

In operation, when the electrical tilt switch 10 is perpendicular relative to a reference horizontal surface (not shown) or only slightly tilted from this perpendicular position, the small and large balls 13, 12 roll toward the electrical connector 15 by gravity, so that the small ball 13 contacts electrically the electrical connector 15 and the housing 11, thereby placing the switch 10 in an ON state. At this time, the large ball 12 is in contact with the small ball 13 so as to press the small ball 13 against the electrical connector 15. When the large and small balls 12, 13 are rolled toward the closed end 112 of the housing 11 (as a result of the electrical tilt switch 10 being sufficiently tilted), the electrical tilt switch 10 is switched to an OFF state.

Another conventional electrical tilt switch, as disclosed in U.S. Pat. No. 5,209,343, includes a conductive housing having a substantially tubular jacket and one open end, a dielectric end cap member covering the open end of the housing, a plurality of conductive balls positioned within the housing, and a terminal connected to the housing.

Although each of the aforementioned conventional electrical tilt switches 10 can achieve its intended purpose, each of the aforementioned electrical tilt switches 10 can be placed in the ON state only when tilted in one direction. In some applications, it would be desirable for the electrical tilt switch to turn on when tilted in more than one direction.

SUMMARY OF THE INVENTION

Therefore, the object of the present invention is to provide a rolling-ball switch that can be placed in an ON state whenever conductive balls in a conductive housing of the rolling-ball switch of the present invention move to either side of the housing.

According to this invention, a rolling-ball switch is adapted to be fixed on a circuit board, and comprises a longitudinal conductive housing, two conductive balls, two insulation caps, and two terminals. The conductive housing has an inner wall that defines a receiving space, and the conductive housing has two opposite open ends that are opposite each other in a longitudinal direction. The receiving space has first and second widths between its inner wall along first and second transverse directions that are transverse to the longitudinal direction and perpendicular to each other. The conductive balls are disposed movably in the receiving space. The insulation caps cover respectively the open ends of the conductive housing to confine the conductive balls in the receiving space. The terminals are connected fixedly and respectively to the insulation caps. Each of the terminals includes an inner section extending into the receiving space. The first width is larger than the sum of diameters of the two conductive balls, the second width is larger than the diameter of each of the conductive balls, the diameter of each of the conductive balls is larger than a distance between the inner section of one of the terminals and the inner wall of the conductive housing, and the two conductive balls are capable of simultaneously bridging said inner section of one of said terminals and said inner wall of said conductive housing to establish therebetween an electrical connection.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
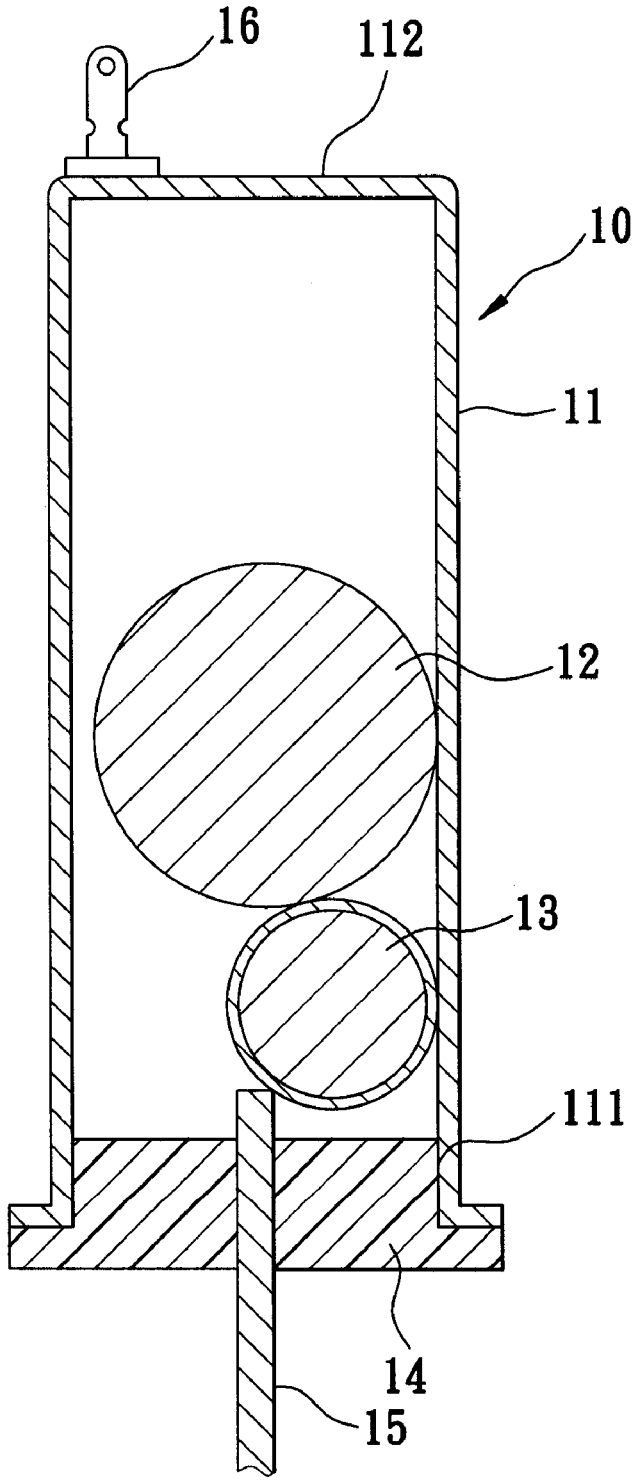
FIG. 1 PRIOR ART
FIG. 1 is a sectional view of a conventional electrical tilt switch disclosed in U.S. Pat. No. 5,332,876.

Before the present invention is described in greater detail, it should be noted that like elements are denoted by the same reference numerals throughout the disclosure.

Referring to FIGS. 2 to 6, the first preferred embodiment of a rolling-ball switch 1 according to the present invention is shown to comprise a conductive housing 21, two conductive balls 30, two insulation caps 40, and two terminals 50.

The conductive housing 21 defines a receiving space 213, and has two opposite open ends 215, and two opposite end faces 214 at the open ends 215, respectively. The receiving space 213 has first and second widths (d1, d2) (see FIG. 6) along first and second directions that are perpendicular to each other. In this embodiment, the receiving space 213 is circular, and the conductive housing 21 is a circular tube. Hence, the first width (d1) is equal to the second width (d2).

The conductive balls 30 are disposed movably in the receiving space 213. Each of the conductive balls 30 has a diameter (d3) (see FIGS. 5 and 6).

The insulation caps 40 cover tightly and respectively the open ends 215 of the conductive housing 21 so as to confine the conductive balls 30 within the receiving space 213. Each of the insulation caps 40 has a neck portion 41 inserted into the receiving space 213 through the respective open end 215 of the housing 21, a head portion 42 projecting outwardly from the neck portion 41 and abutting against a respective one of the end faces 214 of the housing 21, and a through hole 43 extending through the neck and head portions 41, 42.

The terminals 50 are inserted fixedly and respectively into the insulation caps 40 so as to be positioned on the housing 21. Each of the terminals 50 includes an inner section 51 extending into the receiving space 213 through the through hole 43 of the respective cap 40 and formed with a contact edge 511, an outer section 52 opposite to the inner section 51 and disposed outwardly of the respective insulation cap 40, and an engaging section 53 between the inner and outer sections 51, 52 and having protrusions 531 and indentations 532 on an outer surface thereof that are engaged to the through hole 43 of the respective cap 40. The contact edge 511 of the inner section 51 of each terminal 50 is spaced apart radially from an inner wall 212 of the housing 21 by a distance (d4) (see FIGS. 5 and 6).

The first width (d1) is larger than the sum of the diameters (d3) of the two conductive balls 30 so as to permit movement of the conductive balls 30 within the receiving space 212. The diameter (d3) of each conductive ball 30, in turn, is larger than the distance (d4) between the inner section 51 of one of the terminals 50 and the inner wall 212 of the housing 21 so as to prevent each conductive ball 30 from rolling into a space defined between the inner wall 212 of the housing 21 and the inner section 51 of the corresponding terminal 50.

Figure 3:
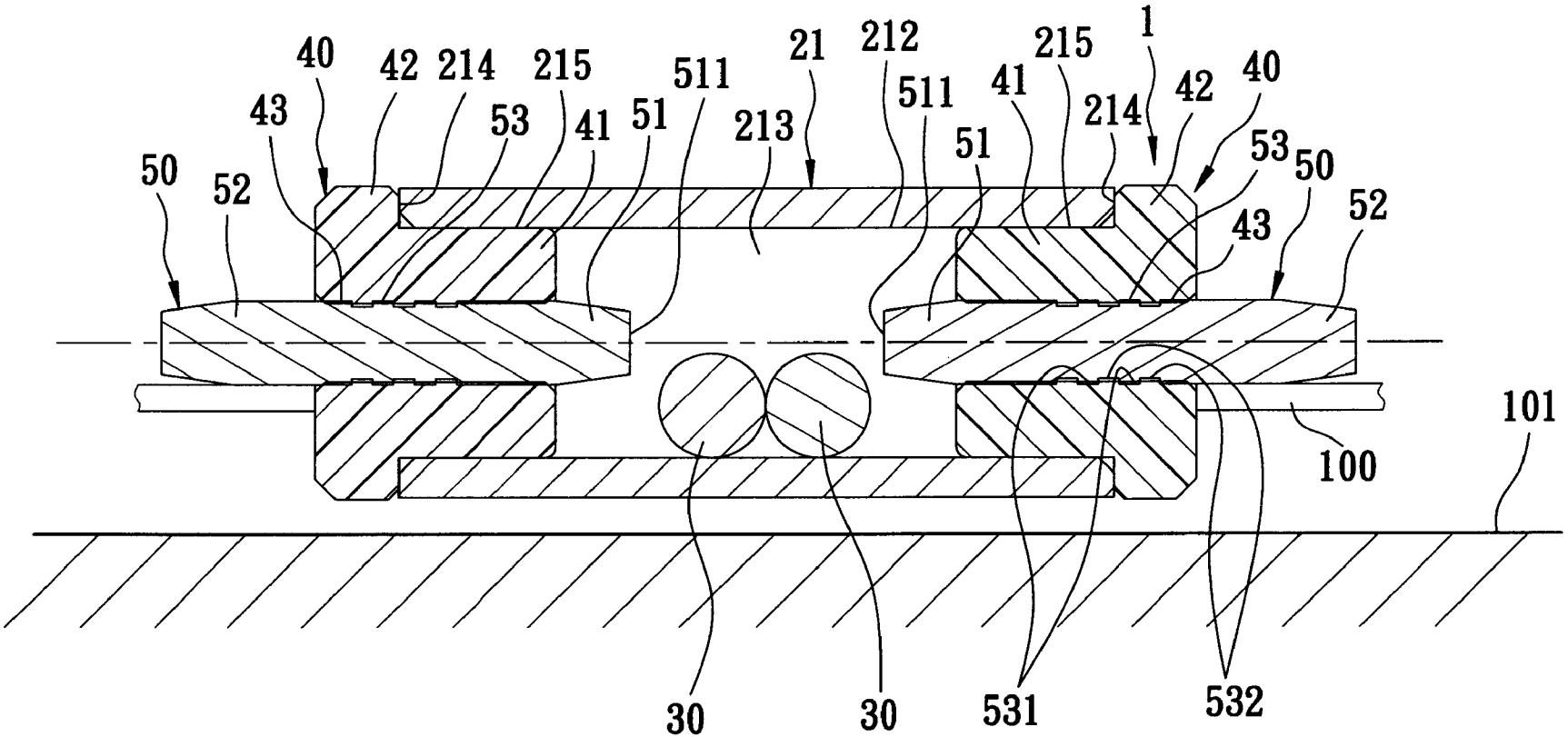
FIG. 3 is an assembled sectional view of the first preferred embodiment mounted on a circuit board.
Figure 4:
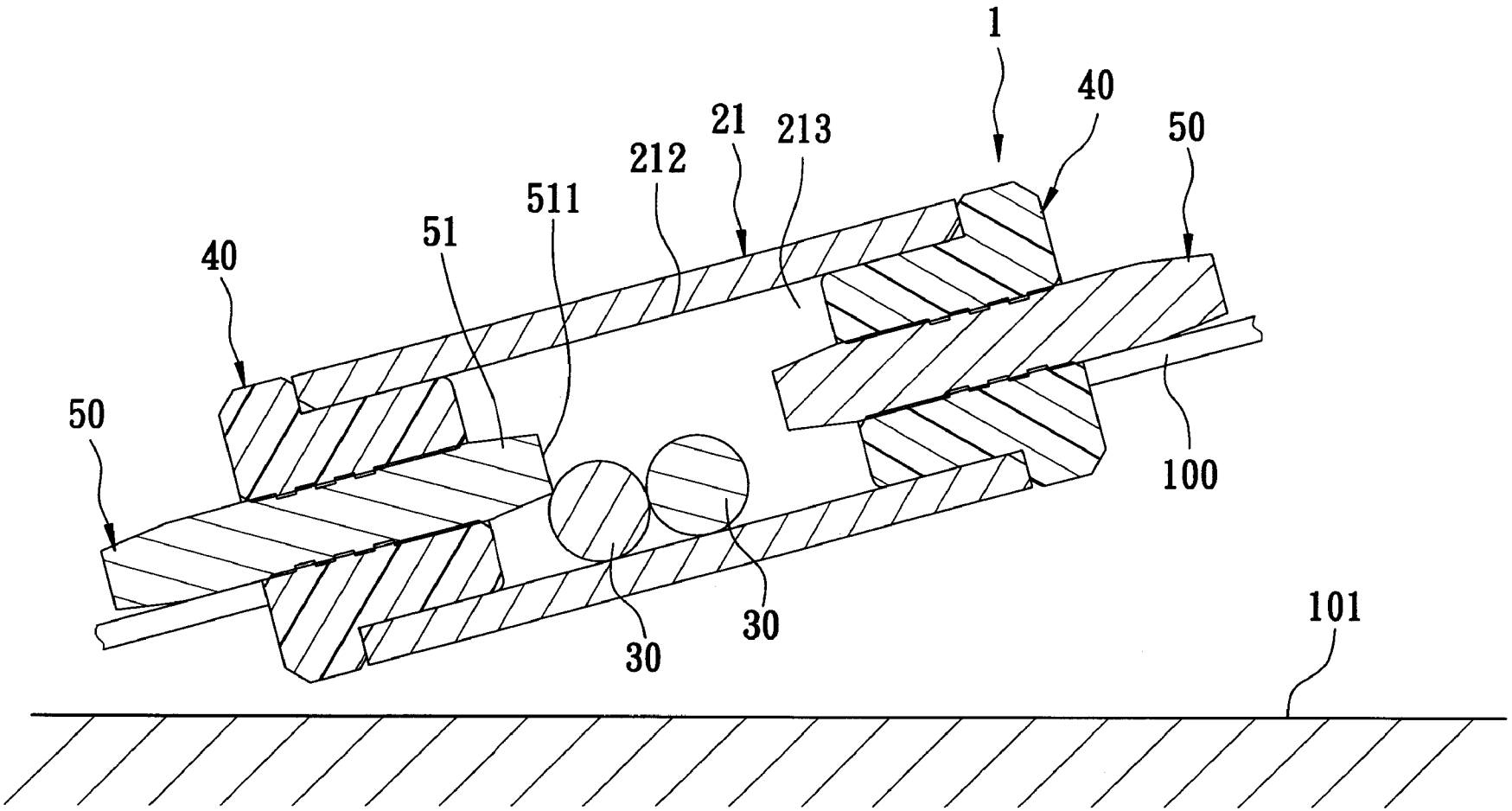
FIG. 4 is a view similar to FIG. 3, but with the circuit board tilted relative to a reference horizontal surface so as to place the rolling-ball switch of the present invention in an ON state.

In operation, the rolling-ball switch 1 is installed fixedly on a circuit board 100. As shown in FIG. 3, when the circuit board 100 is parallel to a reference horizontal surface 101, the conductive balls 30 are not in electrical contact with the inner sections 51 of the terminals 50. Hence, the switch 1 is in an OFF state at this time.

Whenever the circuit board 100 is tilted downward to the left (see FIG. 4) or right (not shown) with respect to the reference horizontal surface 101, the conductive balls 30 roll toward one of the terminals 50 with one of the conductive balls 30 contacting the contact edge 511 of the inner section 51 of the one of the terminals 50 and with the other one of the conductive balls 30 pressing against the one of the conductive balls 30 by force of gravity, thereby coupling electrically the one of the terminals 50 to the conductive housing 21 to turn ON the switch 1.

Figure 5:
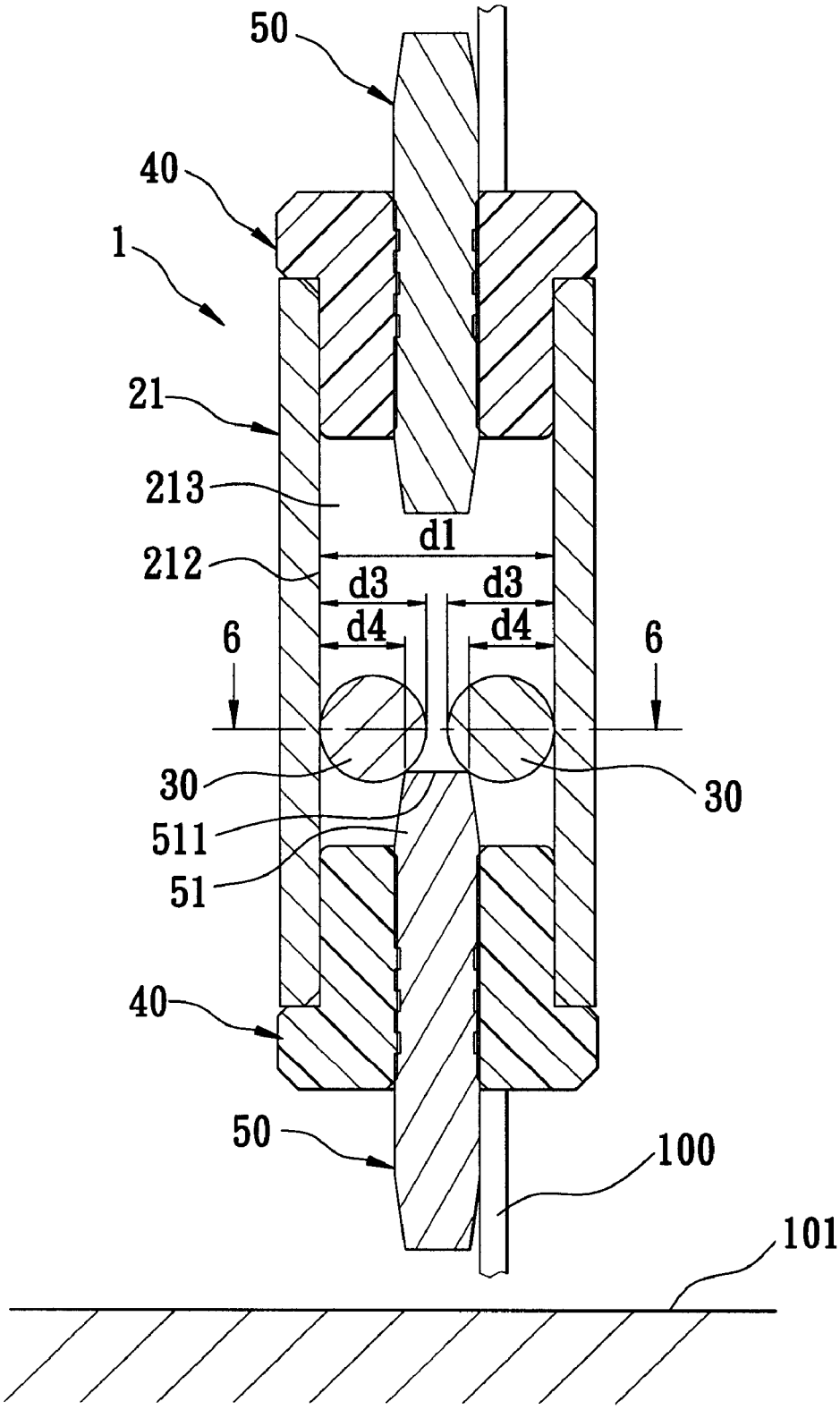
FIG. 5 is a view similar to FIG. 4, but with the circuit board perpendicular to the reference horizontal surface so as to similarly place the rolling-ball switch of the present invention in an ON state.
Figure 6:
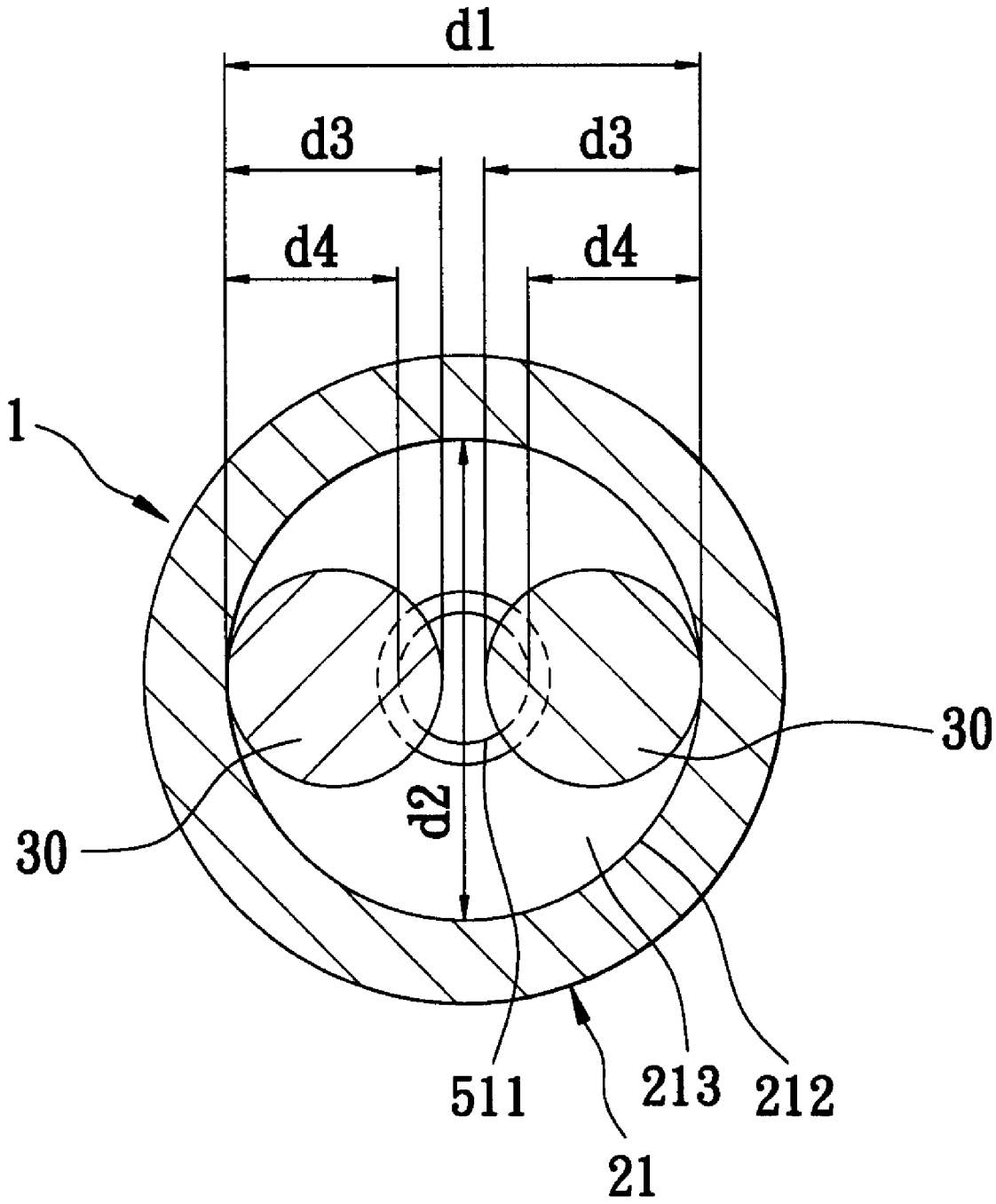
FIG. 6 is a sectional view of the first preferred embodiment taken along line 6-6 of FIG. 5.
Figure 7:
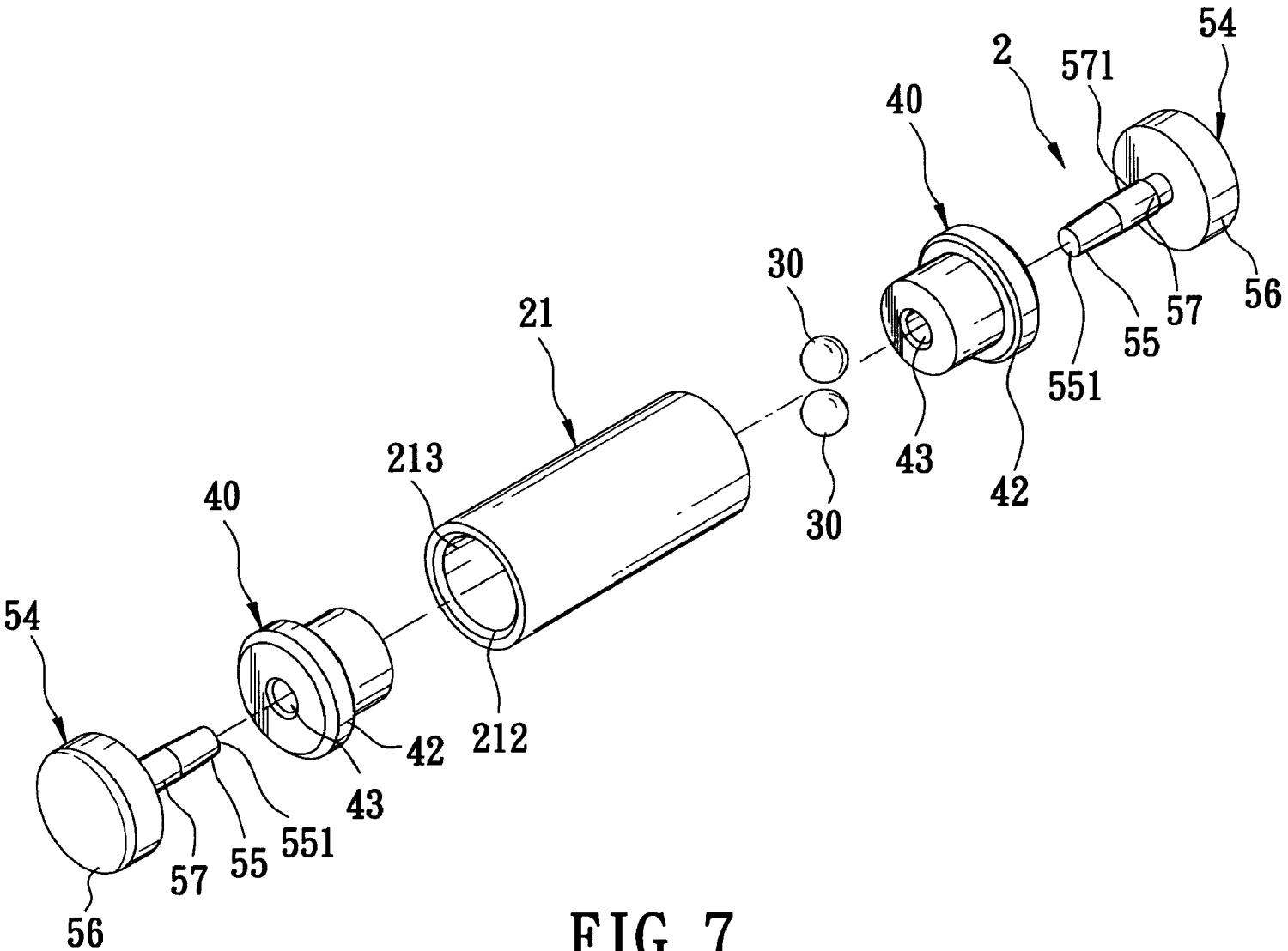
FIG. 7 is an exploded perspective view of a rolling-ball switch according to the second preferred embodiment of the present invention.

With reference to FIGS. 5 and 6, when the circuit board 100 is perpendicular to the reference horizontal surface 101, the two conductive balls 30 roll toward and contact simultaneously the contact edge 511 of the inner section 51 of one of the terminals 50, thereby coupling electrically the one of the terminals 50 to the conductive housing 21 to turn ON the switch 1.

It should be noted that whenever the circuit board 100 is tilted downward to the left or right with respect to the reference horizontal surface 101, the switch 1 may be placed in the ON state, unlike the conventional electrical tilt switch 10 (see FIG. 1) which can be turned ON only when the conductive balls 12, 13 roll to one end 111 of the housing 11.

Referring to FIGS. 7 to 10, a rolling-ball switch 2 according to the second preferred embodiment of the present invention is shown to be similar to the first preferred embodiment. However, in this embodiment, each of the terminals 54 has an enlarged outer section 56 opposite to the inner section 55 and abutting against an outer surface of the head portion 42 of the respective insulation cap 40. Additionally, the engaging section 57 of each terminal 54 has an annular protrusion 571 projecting outwardly from an outer surface thereof and that is engaged to the through hole 43 in the respective insulation cap 40. Since the relations of the size and the distance among the components of the switch 2 are similar to those described in relation to the rolling-ball switch 1 (see FIG. 6) of the first preferred embodiment, a detailed description of the same is dispensed herewith for the sake of brevity.

Figure 8:
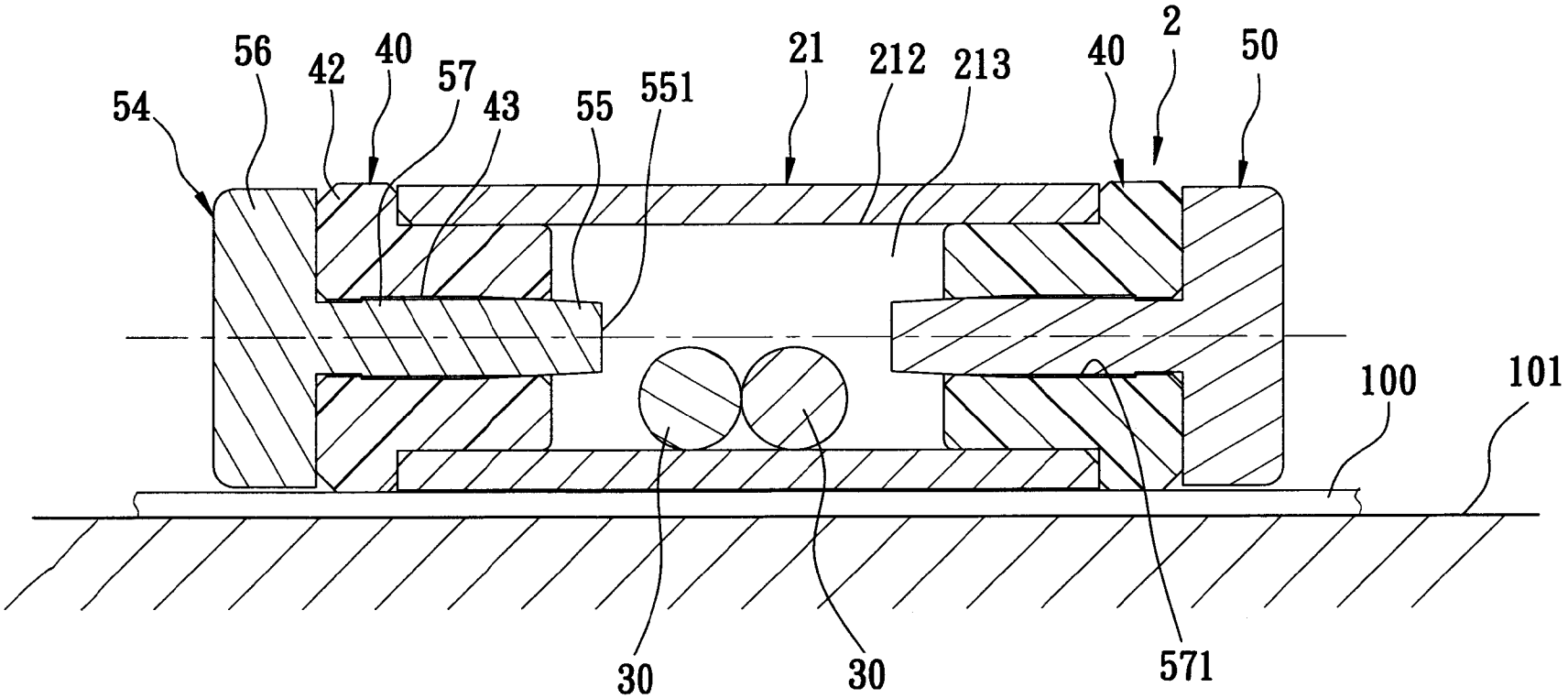
FIG. 8 is an assembled sectional view of the second preferred embodiment mounted on a circuit board.
Figure 9:
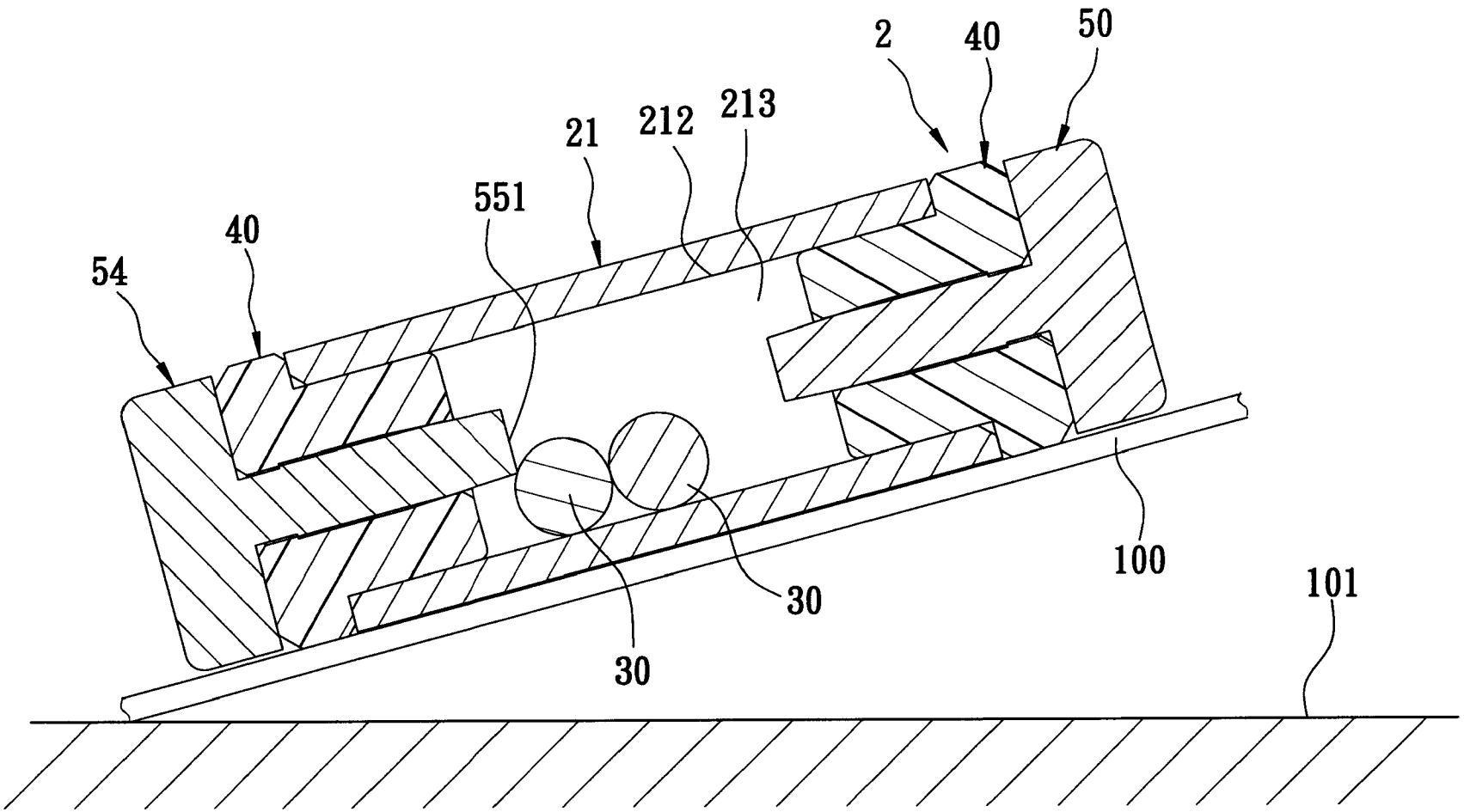
FIG. 9 is a view similar to FIG. 8, but with the circuit board tilted relative to a reference horizontal surface so as to place the rolling-ball switch of the present invention in an ON state.
Figure 10:
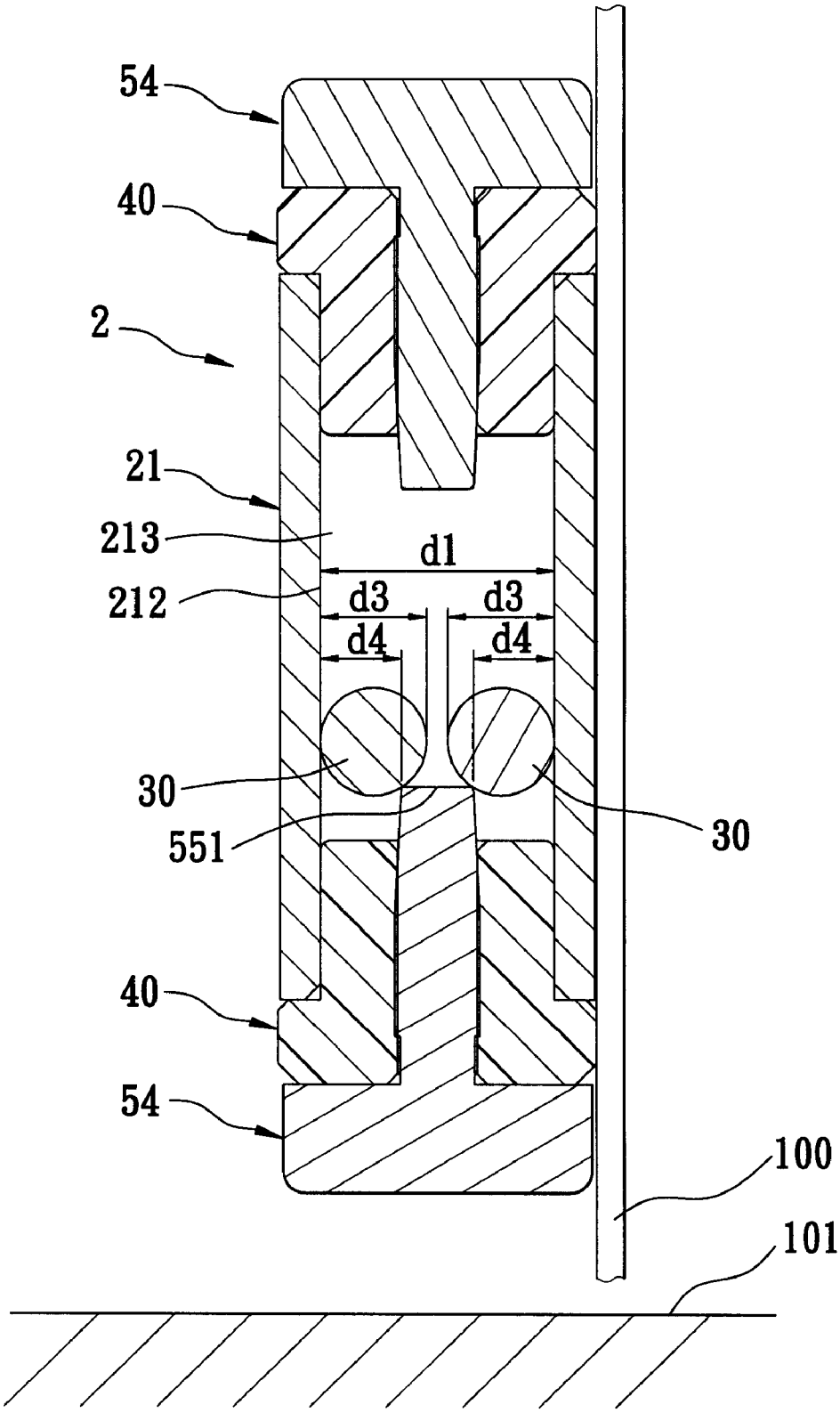
FIG. 10 is a view similar to FIG. 9, but with the circuit board perpendicular to the reference horizontal surface so as to similarly place the rolling-ball switch of the present invention in an ON state.
Figure 11:
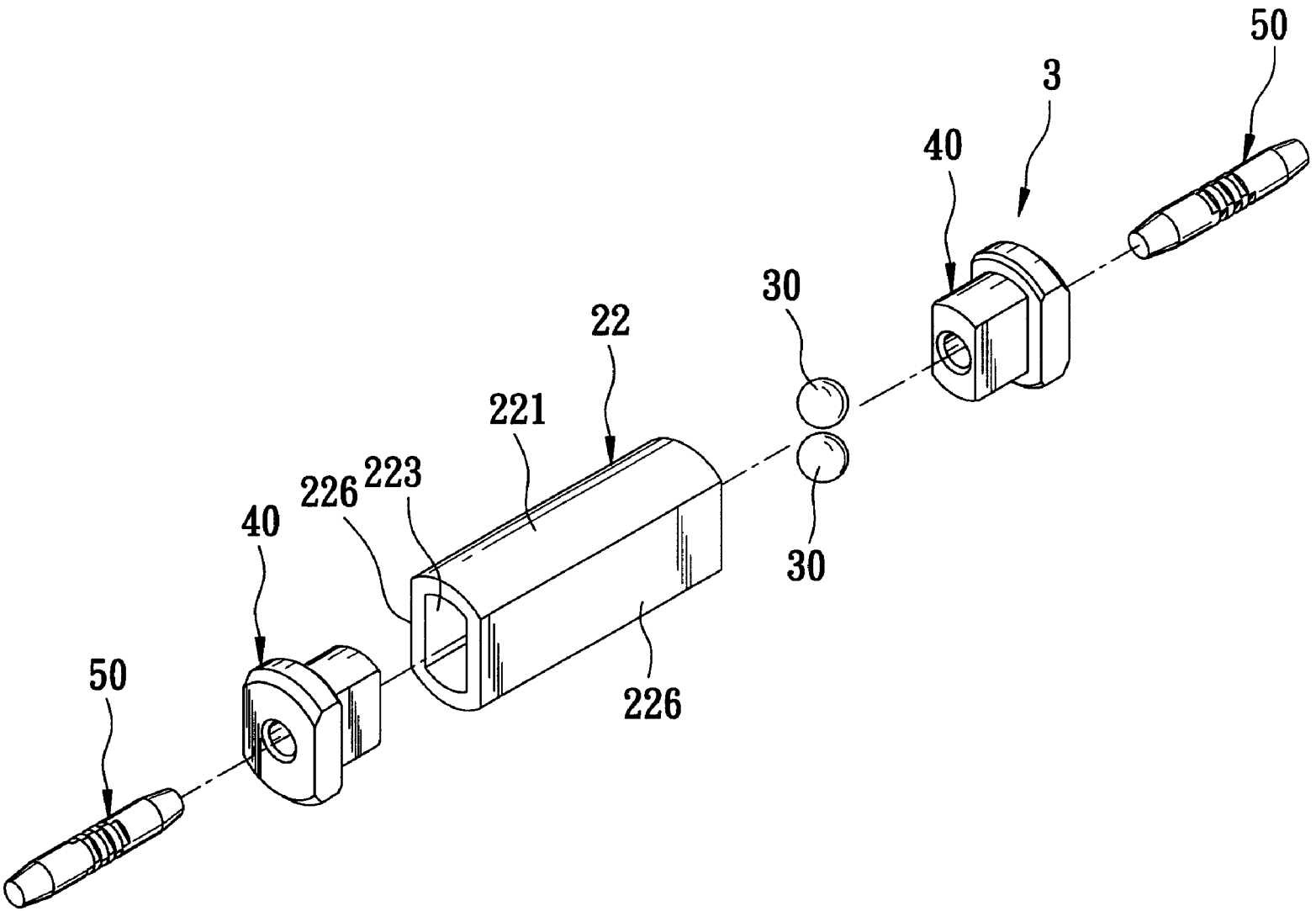
FIG. 11 is an exploded perspective view of a rolling-ball switch according to the third preferred embodiment of the present invention.
Figure 12:
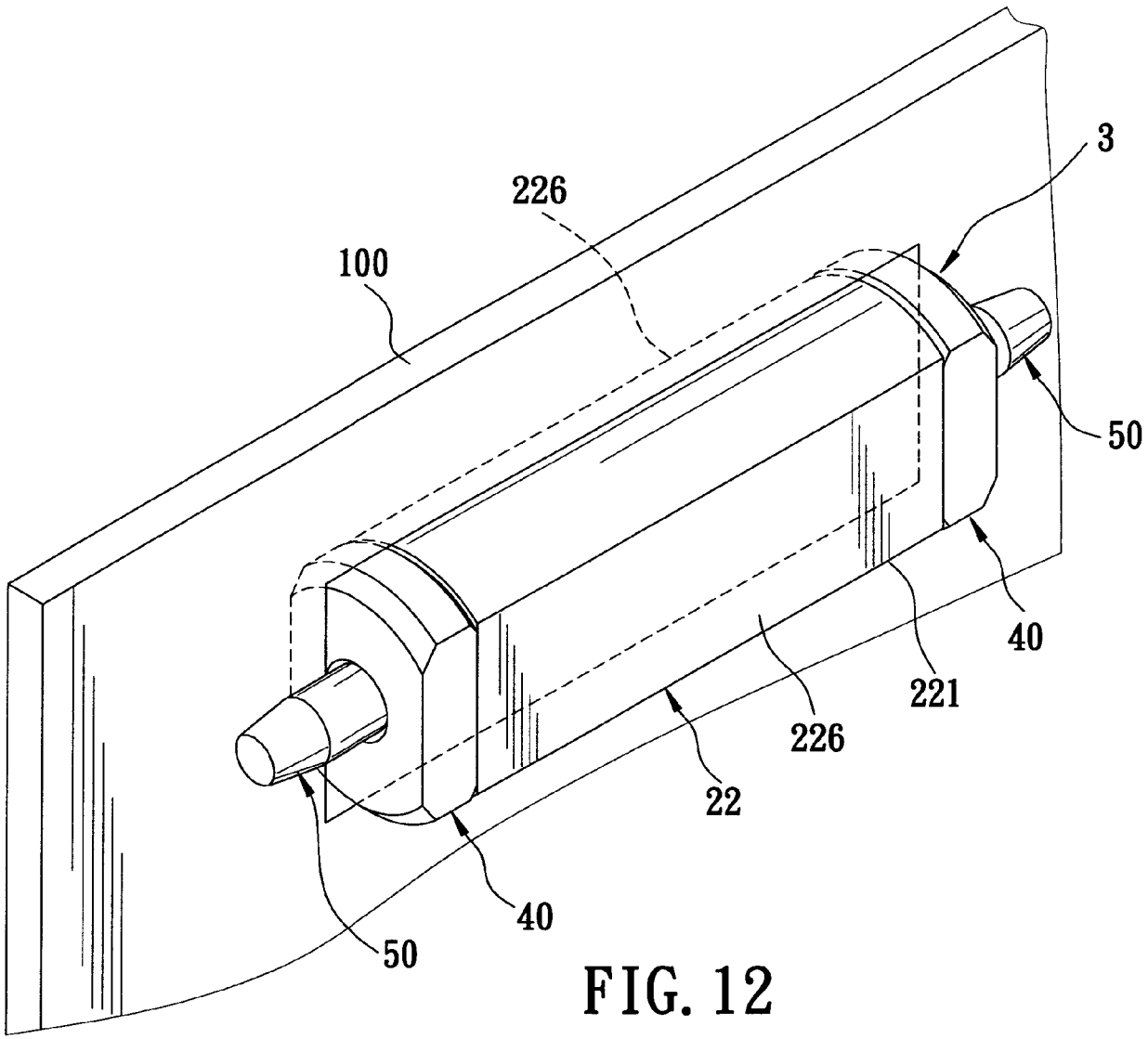
FIG. 12 is an assembled perspective view of the third preferred embodiment mounted on a circuit board.
Figure 13:
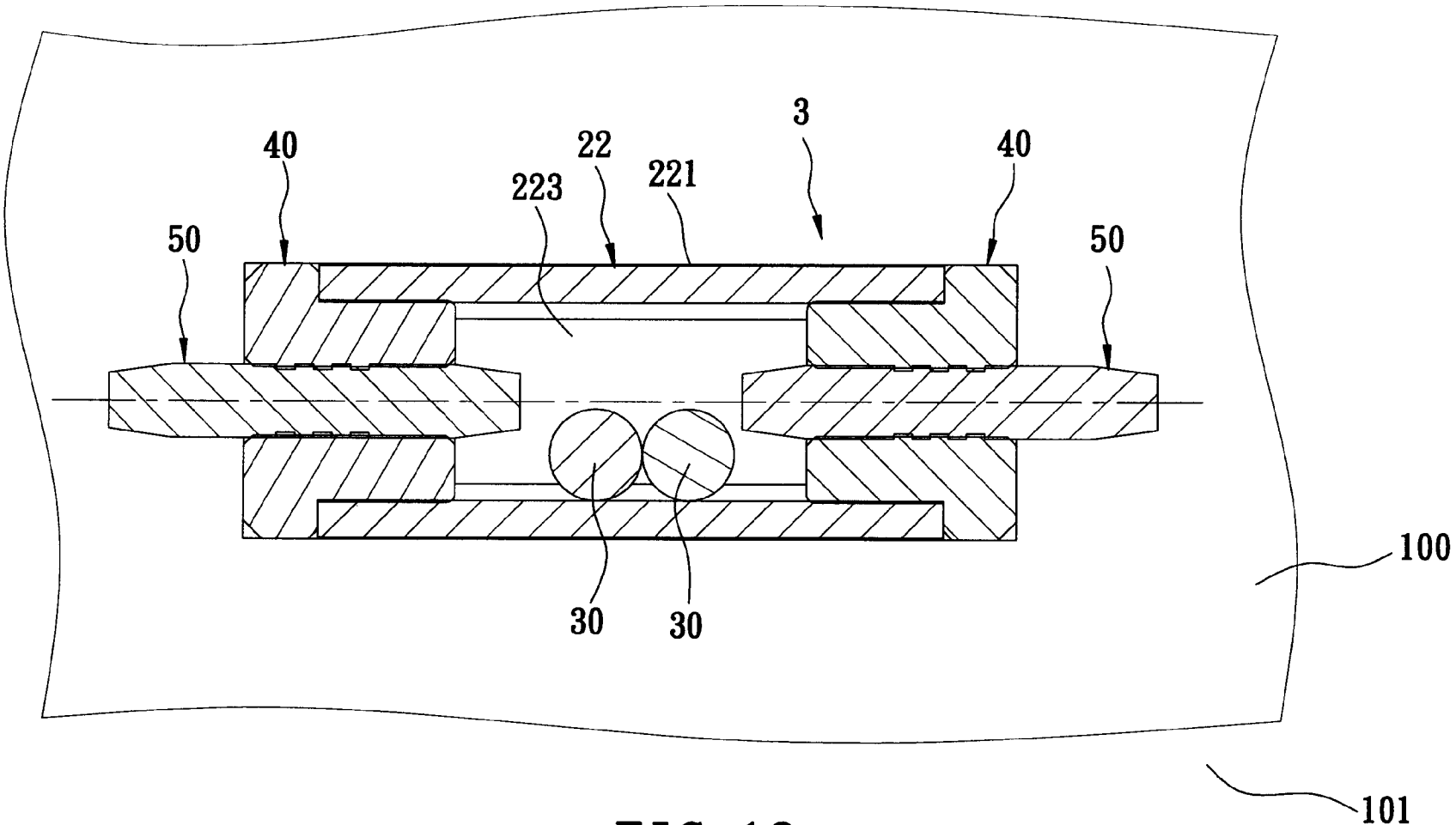
FIG. 13 is an assembled sectional view of the third preferred embodiment mounted on the circuit board.
Figure 14:
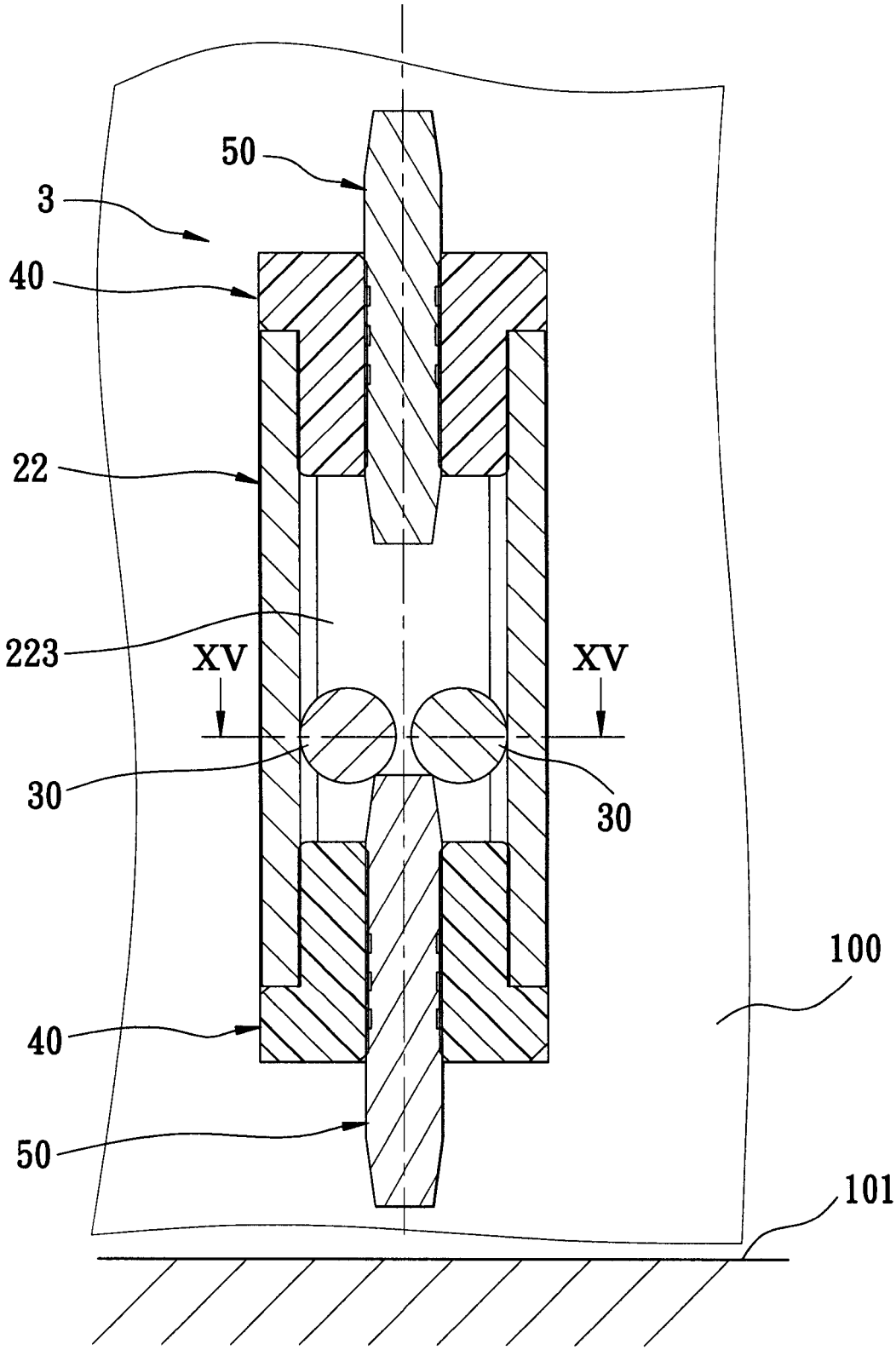
FIG. 14 is a view similar to FIG. 13, but with the circuit board perpendicular to a reference horizontal surface so as to place the rolling-ball switch of the present invention in an ON state.
Figure 15:
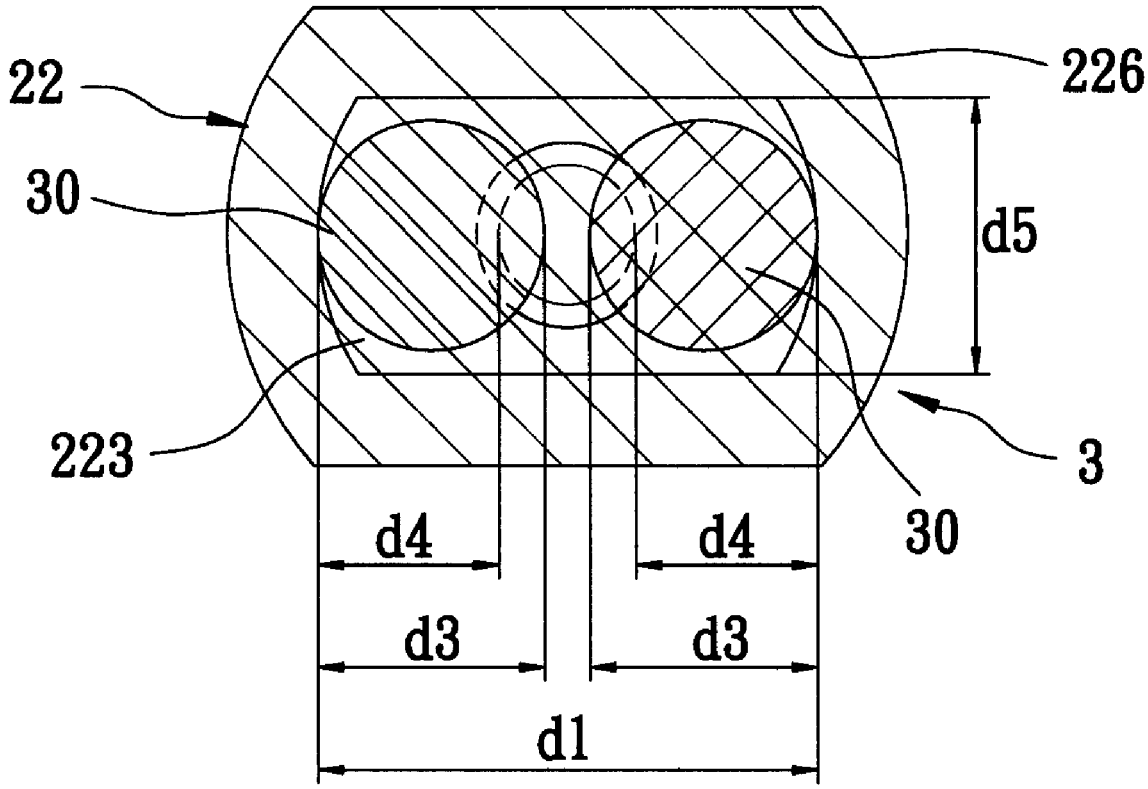
FIG. 15 is a sectional view of the third preferred embodiment taken along line XV-XV of FIG. 14.

In operation, the switch 2 is installed fixedly on the circuit board 100. When the circuit board 100 is parallel to the reference horizontal surface 101, as best shown in FIG. 8, the switch 2 is OFF. When the circuit board 100 is tilted downward to the left (see FIG. 9) or right (not shown) with respect to the reference horizontal surface 101, or is perpendicular to the reference horizontal surface 101 (see FIG. 10), the switch 2 is turned ON due to electrical contact among the conductive balls 30, the contact edge 551 of one of the terminals 54, and the conductive housing 21. The advantages of the first preferred embodiment are similarly achieved using the second preferred embodiment.

Referring to FIGS. 11 to 15, a rolling-ball switch 3 according to the third preferred embodiment of the present invention is shown to be similar to the first preferred embodiment. However, in this embodiment, the receiving space 223 of the conductive housing 22 has the first width (d1) larger than the second width (d5) and larger than the sum of the diameters (d3) of the conductive balls 30, and the second width (d5) is larger than the diameter of each conductive ball 30. An outer wall 221 of the housing 22 has two opposite flat surfaces 226. Consequently, the width of the switch 3 along the direction of the second width (d5) is reduced so as to result in an overall size reduction of a final product.

In operation, when the circuit board 100 is parallel to the reference horizontal surface 101, the switch 3 is turned OFF. When the circuit board 100 is tilted downward to the left or right (both not shown) with respect to the reference horizontal surface 101, or is perpendicular to the reference horizontal surface 101 (see FIG. 14), the switch 3 is turned ON.

The advantages of the first preferred embodiment can be similarly achieved using the third preferred embodiment.

Figure 16:
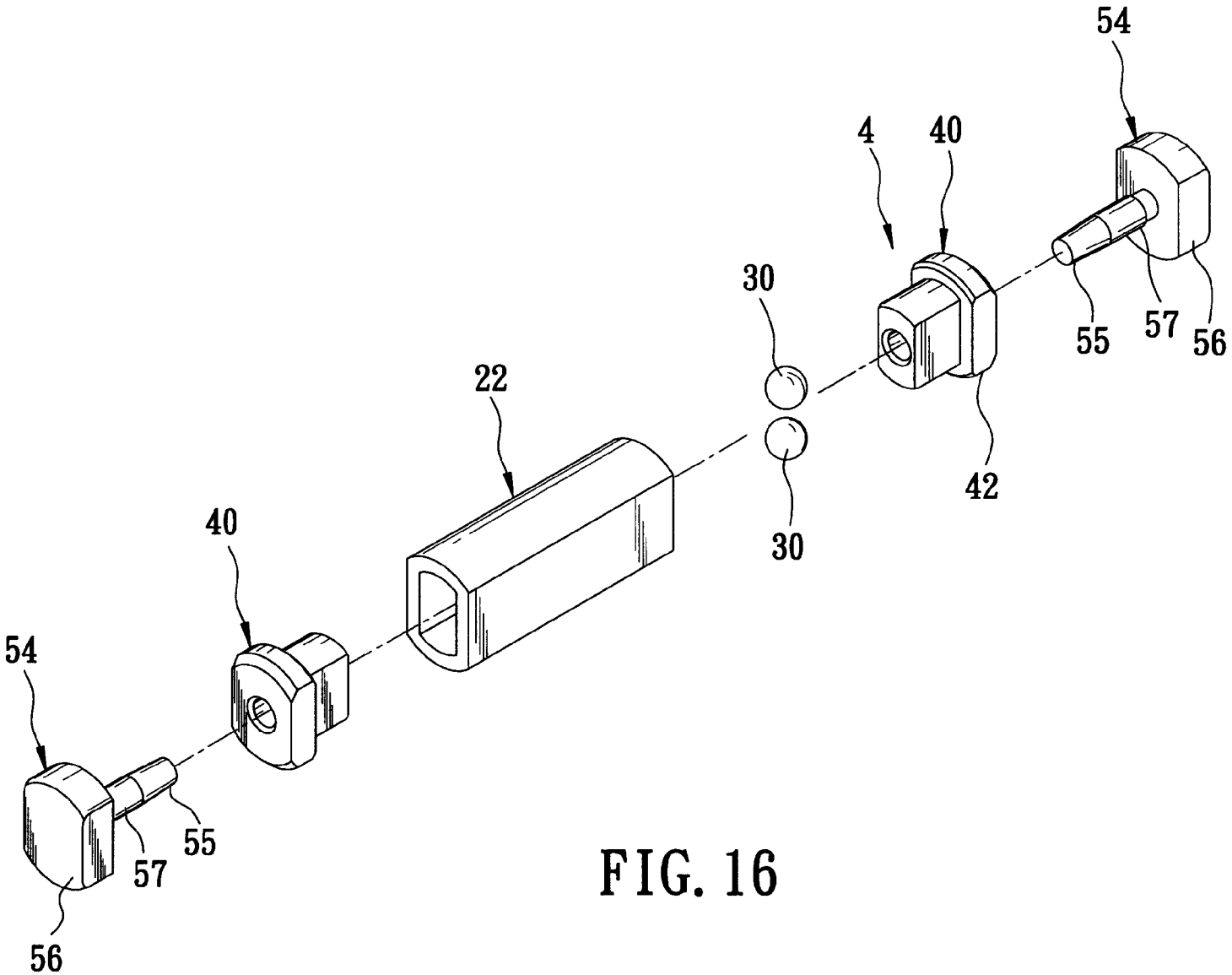
FIG. 16 is an exploded perspective view of a rolling-ball switch according to the fourth preferred embodiment of the present invention.
Figure 17:
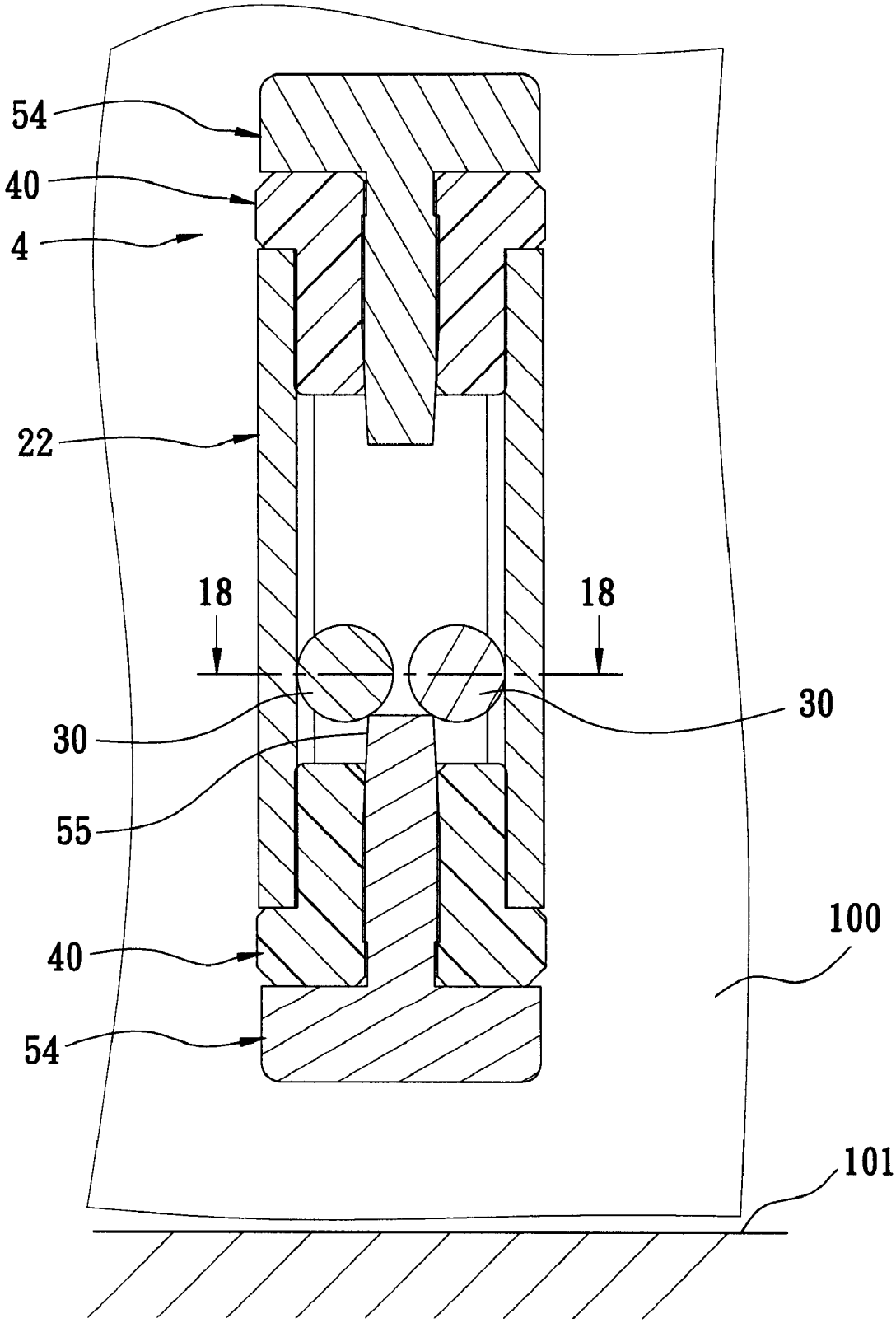
FIG. 17 is an assembled sectional view of the fourth preferred embodiment mounted on a circuit board.
Figure 18:
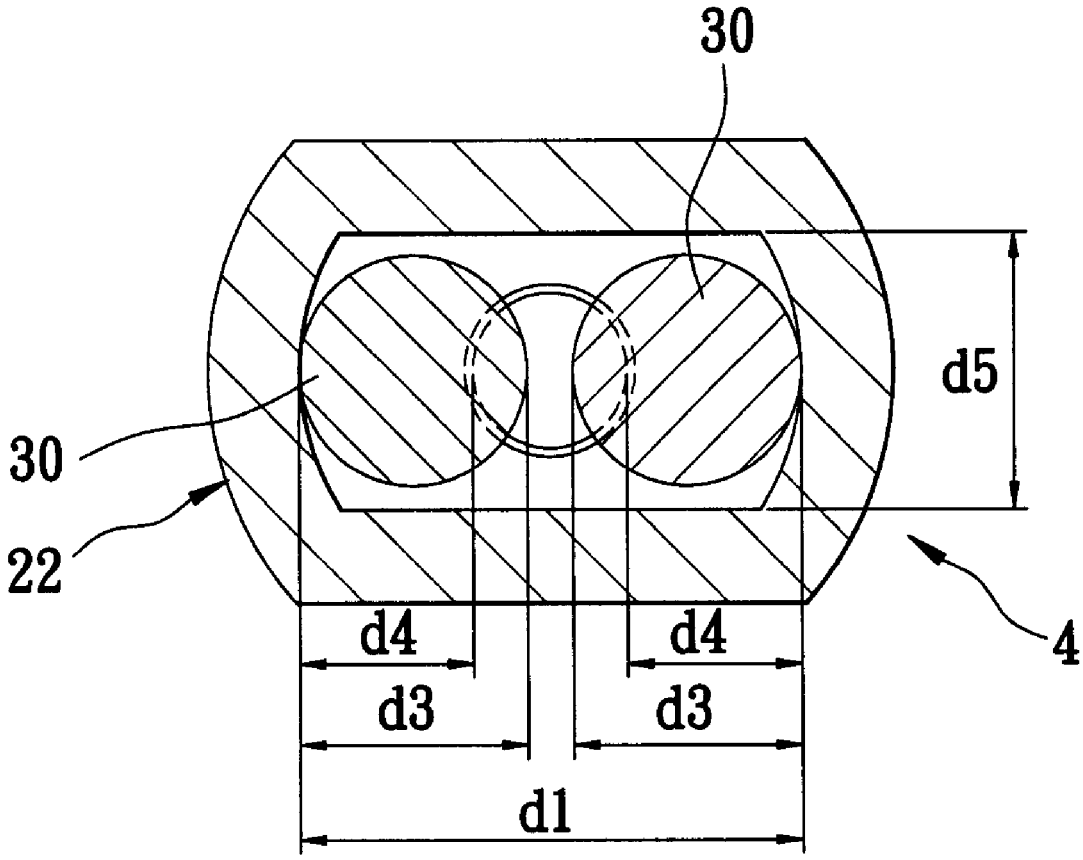
FIG. 18 is a sectional view of the fourth preferred embodiment taken along line 18-18 of FIG. 17.
Figure 19:
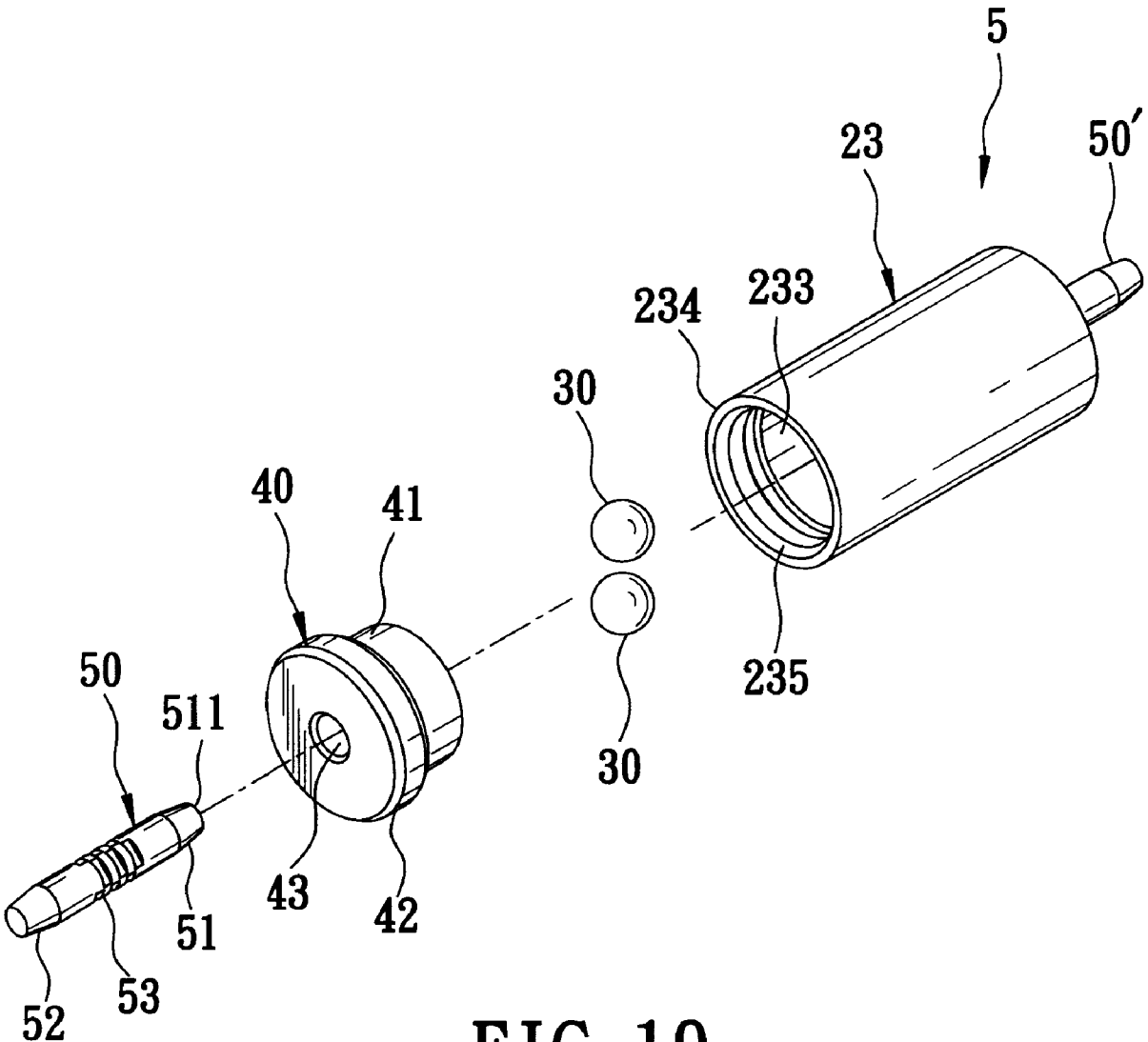
FIG. 19 is an exploded perspective view of a rolling-ball switch according to the fifth preferred embodiment of the present invention.

Referring to FIGS. 16, 17, and 18, a rolling-ball switch 4 according to the fourth preferred embodiment of the present invention is shown to be similar to the third preferred embodiment. The main difference between the third and fourth preferred embodiments resides in the configuration of the terminals 54. In this embodiment, each of the terminals 54 has a construction similar to that illustrated in FIG. 7 of the switch 2 of the second preferred embodiment. Particularly, each terminal 54 includes an engaging section 57, an inner section 55, and an enlarged outer section 56 abutting against an outer surface of the head portion 42 of the respective insulation cap 40.

Since the relations of the size and the distance among the components of the switch 4 are similar to those described in relation to the switch 3 of the third preferred embodiment, and the operations and advantages of the fourth preferred embodiment are also similar to those described in relation to the switch 1 of the first preferred embodiment, a detailed description of the same is dispensed herewith for the sake of brevity.

Referring to FIGS. 19 to 22, a rolling-ball switch 5 according to the fifth preferred embodiment of the present invention is shown to comprise a conductive housing 23, two conductive balls 30, an insulation cap 40, and two terminals 50, 50'.

The conductive housing 23 defines a receiving space 233, and has an open end 235, a closed end 236 opposite to the open end 235, and an end face 234 at the open end 235. The receiving space 233 has first and second widths (d1, d2) (see FIG. 6 for the second width) along first and second directions that are perpendicular to each other. The first width (d1) is equal to the second width (d2). The conductive balls 30 are disposed within the receiving space 233. Each conductive ball 30 has a diameter (d3).

Figure 2:
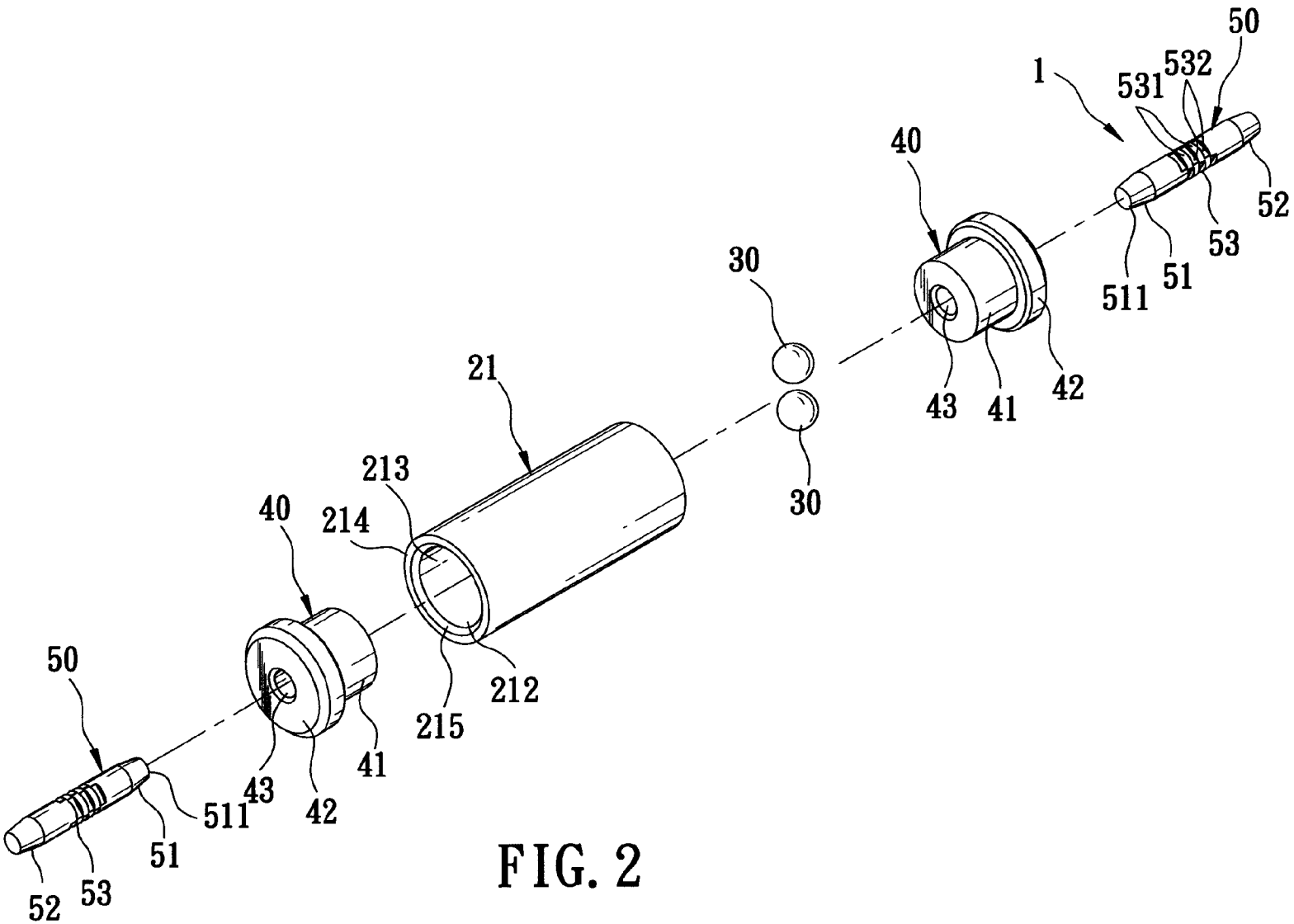
FIG. 2 is an exploded perspective view of the first preferred embodiment of a rolling-ball switch according to the present invention.

The insulation cap 40 covers tightly the open end 235 of the conductive housing 23 so as to confine the conductive balls 30 within the receiving space 233, and has a configuration similar to that of the insulation cap 40 of the rolling-ball switch 1 (see FIG. 2). Particularly, the insulation cap 40 has a neck portion 41, a head portion 42, and a through hole 43.

The terminal 50 has a configuration similar to that of the terminal 50 of the rolling-ball switch 1 (see FIG. 2). Particularly, the terminal 50 includes an inner section 51 with a contact edge 511, an outer section 52 opposite to the inner section 51 and abutting against an outer surface of the head portion 42 of the insulation cap 40, and an engaging section 53 engaged to the through hole 43 in the insulation cap 40. The terminal 50' is inserted into the closed end 236 of the conductive housing 23.

Since the relations of the size and the distance among the components of the switch 5 are similar to those described in relation to the switch 1 (see FIG. 6) of the first preferred embodiment, a detailed description of the same is dispensed herewith for the sake of brevity.

Figure 20:
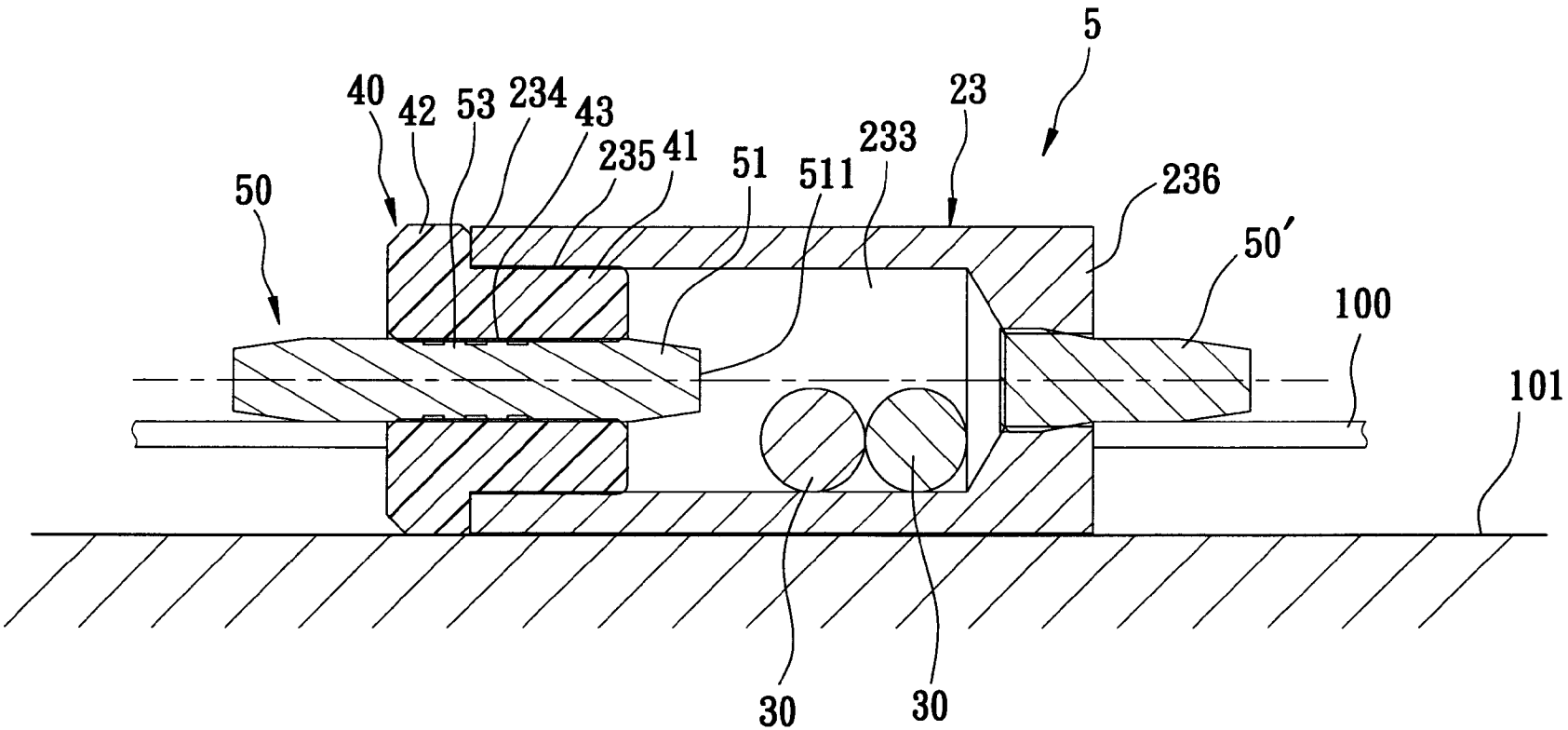
FIG. 20 is an assembled sectional view of the fifth preferred embodiment mounted on a circuit board.

In operation, as shown in FIG. 20, the conductive housing 23 is installed fixedly to the circuit board 100. When the circuit board 100 is parallel to the reference horizontal surface 101, the conductive balls 30 are not in electrical contact with the contact edge 511 of the terminal 50. Hence, the switch 5 is turned OFF at this time.

Figure 21:
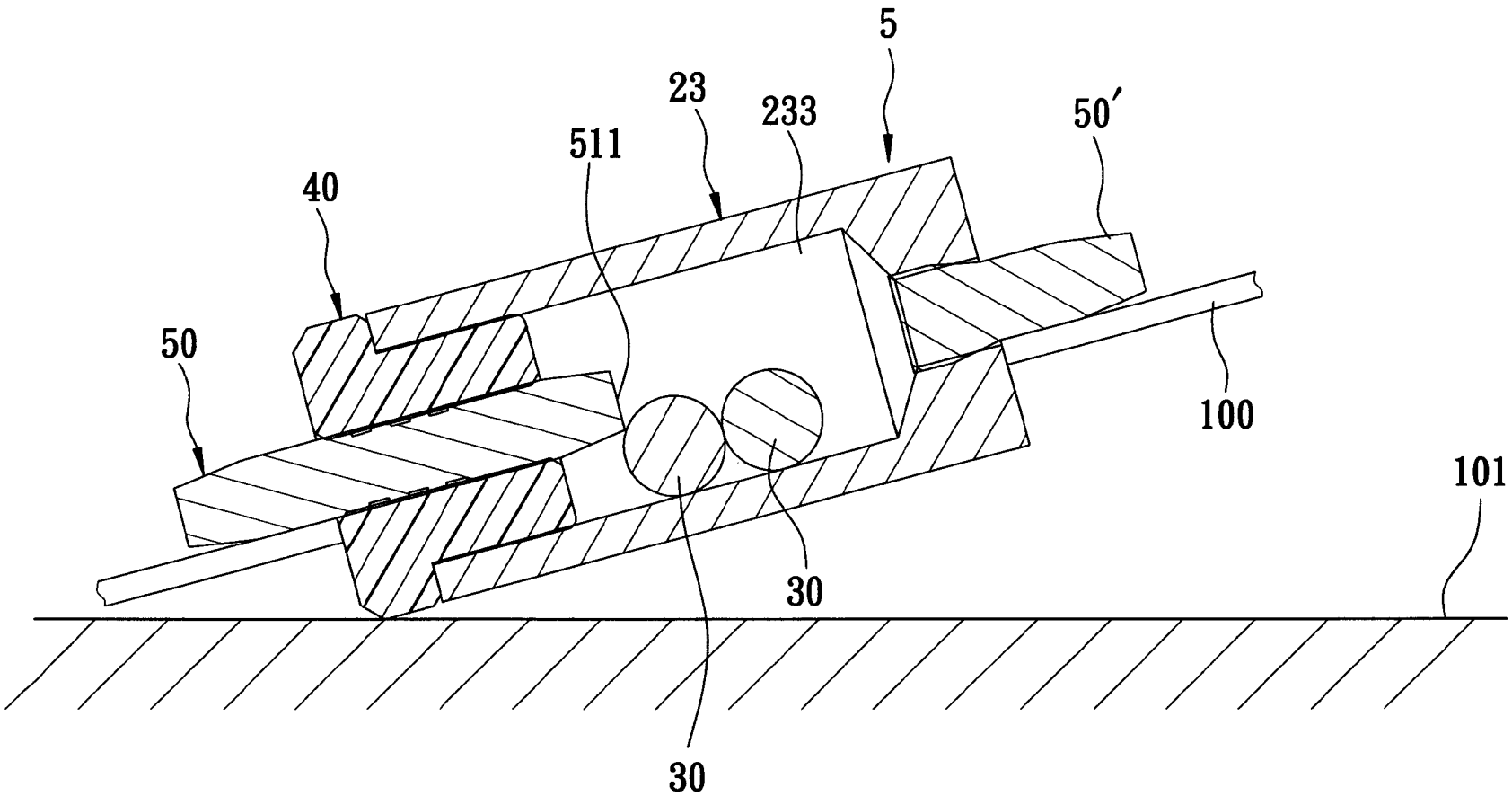
FIG. 21 is a view similar to FIG. 20, but with the circuit board tilted relative to a reference horizontal surface.

When the circuit board 100 is tilted downward to the left with respect to the reference horizontal surface 101, as shown in FIG. 21, the conductive balls 30 roll toward the inner section 51 of the terminal 50 with one of the conductive balls 30 contacting the contact edge 511 of the inner section 51 of the terminal 50 and with the other one of the conductive balls 30 pressing against the one of the conductive balls 30 by force of gravity so as to couple electrically the terminal 50 to the conductive housing 23, thereby placing the switch 5 in an ON state.

Figure 22:
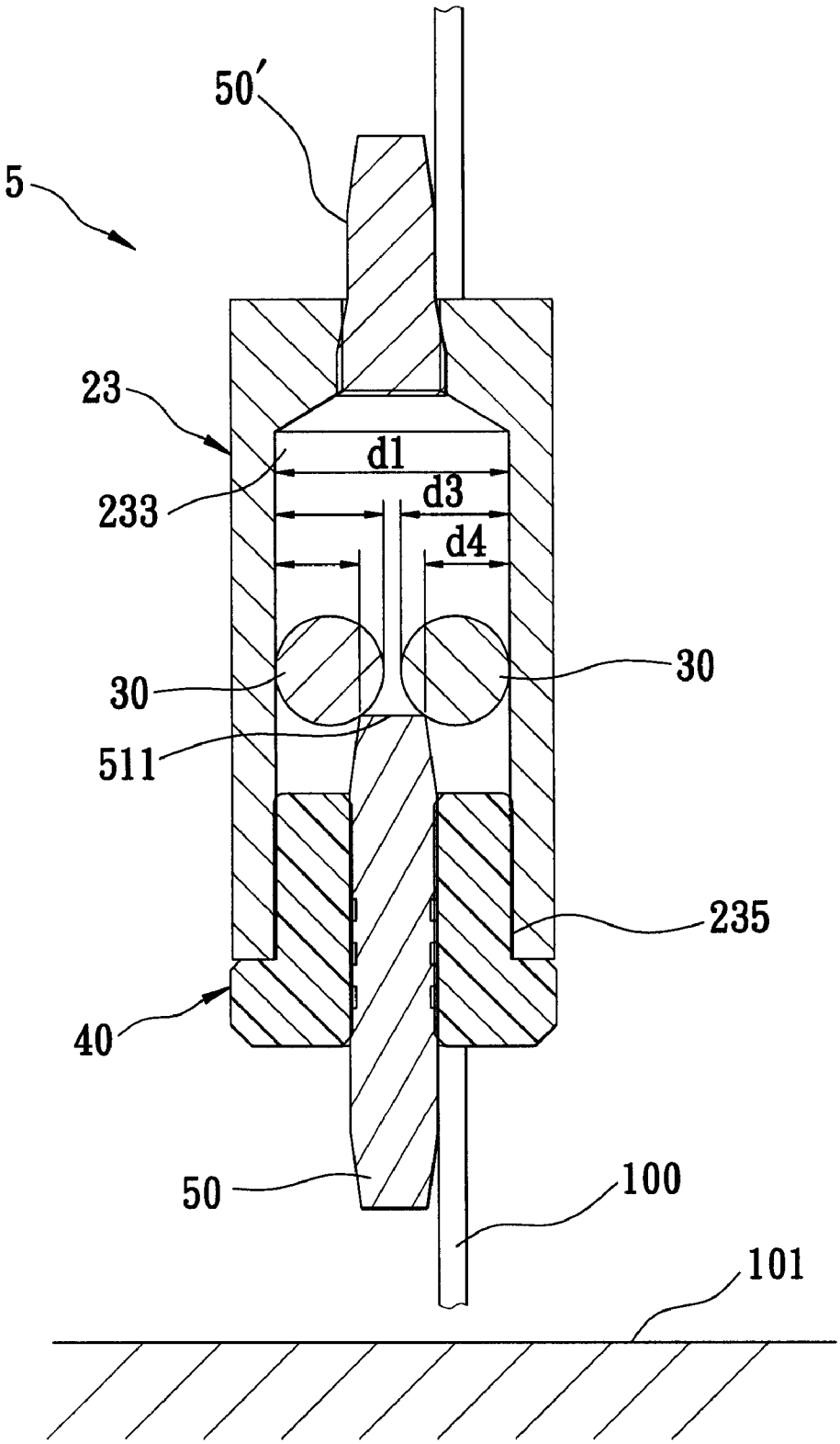
FIG. 22 is a view similar to FIG. 20, but with the circuit board perpendicular to the reference horizontal surface.

With reference to FIG. 22, when the circuit board 100 is perpendicular to the reference horizontal surface 101 in such a manner that the open end 235 is positioned lower than the closed end 236, the conductive balls 30 roll toward and contact simultaneously the contact edge 511 of the inner section 51 of the terminal 50 so as to couple electrically the terminal 50 to the conductive housing 23, thereby placing the switch 5 in an ON state.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A rolling-ball switch adapted to be fixed on a circuit board, said rolling-ball switch comprising:

a longitudinal conductive housing having an inner wall defining a receiving space, and the housing having two open ends that are opposite to each other in a longitudinal direction, said receiving space having first and second widths between the inner wall along first and second transverse directions that are transverse to the longitudinal direction and that are perpendicular to each other;

two conductive balls disposed movably in said receiving space;

two insulation caps covering respectively said open ends of said conductive housing to confine said conductive balls in said receiving space; and two terminals connected fixedly and respectively to said insulation caps, each of said terminals including an inner section extending into said receiving space;

wherein said first width is larger than the sum of diameters of said two conductive balls, said second width is larger than the diameter of each of said conductive balls, and the diameter of each of said conductive balls is larger than a distance between said inner section of one of said terminals and the inner wall of said conductive housing; and wherein said two conductive balls are capable of simultaneously bridging said inner section of one of said terminals and said inner wall of said conductive housing to establish therebetween an electrical connection.

2. The rolling-ball switch of claim 1, wherein said first width is equal to said second width.

3. The rolling-ball switch of claim 2, wherein said first width is larger than said second width.

4. The rolling-ball switch of claim 1, wherein said conductive housing further has two opposite end faces at said open ends, respectively, each of said insulation caps having a neck portion inserted into a respective one of said open ends of said conductive housing, a head portion projecting outwardly from said neck portion and abutting against a respective one of said end faces of said conductive housing, and a through hole extending through said head portion and said neck portion.

5. The rolling-ball switch of claim 4, wherein each of said terminals further includes an enlarged outer section opposite to said inner section of a respective one of said terminals and abutting against an outer surface of said head portion of a respective one of said insulation caps, and an engaging section between said inner and enlarged outer sections and engaged to said through hole in the respective one of said insulation caps.

* * * * *